US010858218B2

(12) United States Patent
Shibata et al.

(10) Patent No.: US 10,858,218 B2
(45) Date of Patent: Dec. 8, 2020

(54) ELEVATOR APPARATUS

(71) Applicant: MITSUBISHI ELECTRIC CORPORATION, Chiyoda-ku (JP)

(72) Inventors: Masunori Shibata, Chiyoda-ku (JP); Takuo Kugiya, Chiyoda-ku (JP); Kazunori Washio, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 503 days.

(21) Appl. No.: 15/743,407

(22) PCT Filed: Jul. 22, 2015

(86) PCT No.: PCT/JP2015/070813
§ 371 (c)(1),
(2) Date: Jan. 10, 2018

(87) PCT Pub. No.: WO2017/013763
PCT Pub. Date: Jan. 26, 2017

(65) Prior Publication Data

US 2018/0201477 A1 Jul. 19, 2018

(51) Int. Cl.
*B65B 5/00* (2006.01)
*B66B 5/06* (2006.01)
(Continued)

(52) U.S. Cl.
CPC ..... *B66B 5/0031* (2013.01); *B66B 1/3492* (2013.01); *B66B 5/0018* (2013.01); *B66B 5/06* (2013.01)

(58) Field of Classification Search
CPC ... B66B 5/0031; B66B 1/3492; B66B 5/0018; B66B 5/06
See application file for complete search history.

(56) References Cited

U.S. PATENT DOCUMENTS 6,196,355 B1 * 3/2001 Fargo ..... B66B 3/00 187/393
8,944,217 B2 * 2/2015 Anasis ..... B66D 1/605 187/224
(Continued)

FOREIGN PATENT DOCUMENTS

EP 2380841 A1 10/2011
EP 2 660 179 6/2013
(Continued)

OTHER PUBLICATIONS

Korean Office Action dated Mar. 28, 2019 in Korean Application No. 10-2018-7005149.
(Continued)

*Primary Examiner* — Jeffrey Donels
(74) *Attorney, Agent, or Firm* — Xsensus LLP

(57) ABSTRACT

This invention is concerning an elevator apparatus, in which a safety monitoring device corrects a detected car position using a signal from a car position detection device and monitors the presence or absence of car overspeed on the basis of an overspeed detection pattern that varies in accordance with car position. The car position detection device includes a first car position detection sensor and a second car position detection sensor which are arranged side by side in a vertical direction. The safety monitoring device performs, in parallel, first overspeed monitoring based on a car position corrected using a signal from the first car position detection sensor and second overspeed monitoring based on a car position corrected using a signal from the second car position detection sensor.

10 Claims, 5 Drawing Sheets

(51) Int. Cl.
*B66B 1/34* (2006.01)
*B66B 5/00* (2006.01)

(56) References Cited

U.S. PATENT DOCUMENTS

| | | | | |
|---|---|---|---|---|
| 2004/0200671 | A1* | 10/2004 | Kugiya | B66B 5/06 187/293 |
| 2007/0000736 | A1* | 1/2007 | Shikai | B66B 5/0037 187/393 |
| 2008/0190710 | A1* | 8/2008 | Shiratsuki | B66B 5/12 187/393 |
| 2012/0138392 | A1* | 6/2012 | Anasis | E04G 3/32 187/298 |
| 2015/0336768 | A1* | 11/2015 | Otsuka | B66B 1/36 187/394 |
| 2016/0021483 | A1 | 7/2016 | Banno et al. | |
| 2016/0214832 | A1* | 7/2016 | Banno | B66B 1/3492 |

FOREIGN PATENT DOCUMENTS

| | | | |
|---|---|---|---|
| JP | 5321731 | B2 | 7/2013 |
| JP | 2015-013731 | A | 1/2015 |
| KR | 10-2000-0001155 | | 1/2000 |
| KR | 10-2013-0061758 | | 6/2013 |
| WO | 2011/111096 | A1 | 9/2011 |
| WO | 2015/040734 | | 3/2015 |

OTHER PUBLICATIONS

International Search Report dated Oct. 6, 2015 in PCT/JP2015/070813, filed on Jul. 22, 2015.
Korean Notification of Reason for Refusal dated Sep. 26, 2019 in Korean Application No. 10-2018-7005149.
Office Action dated Nov. 14, 2019, issued in corresponding Indian Patent Application No. 201847004543, 6 pages.

* cited by examiner

ELEVATOR APPARATUS

TECHNICAL FIELD

The present invention relates to an elevator apparatus which includes a safety monitoring device for monitoring the presence or absence of car overspeed on the basis of an overspeed detection pattern that varies according to a car position.

BACKGROUND ART

In a conventional elevator safety system, a speed governor is provided with a pulse generating device with which a pulse signal is generated by the running of a car. A plurality of floor detection plates are provided in a hoistway. Further, end floor detection plates are provided respectively at an upper end section and a lower end section of the hoistway. In addition, the car is provided with a car position sensor for detecting the floor detection plates and an end floor detection device for detecting the end floor detection plates. A safety controller ascertains a relationship between the positions of the floor detection plates and the signal output from the pulse generating device on the basis of a detection signal from the end floor detection device, a detection signal from the car position sensor, and the signal output from the pulse generating device (see PTL 1, for example).

CITATION LIST

Patent Literature

[PTL 1] Japanese Patent Application Publication No. 2015-13731

SUMMARY OF THE INVENTION

Problem to be Solved by the Invention

In a conventional safety system such as that described above, it is necessary to dual-configure the car position sensor and perform a comparative check on signals detected by two car position sensors in order to secure a high degree of reliability required. Moreover, since the floor detection plates are detected by two car position sensors, the floor detection plates also need to be dual-configured. In such a case, two floor detection plates are arranged side by side in the horizontal direction on each floor, which restricts hoistway layout design.

The present invention has been made to solve the above-mentioned problem, and an object thereof is to obtain an elevator apparatus with which reliability of an overspeed monitoring function can be sufficiently ensured while suppressing the number of detection members to be installed in a hoistway.

Means for Solving the Problem

An elevator apparatus according to the present invention is an elevator apparatus provided with: a car which ascends and descends in a hoistway; a reference position detector which detects that the car is located at a reference position in the hoistway; a movement signal generator that generates a signal that corresponds to an amount of movement of the car; a detection member which is installed in the hoistway; a car position detection device which is mounted on the car and detects the detection member; and a safety monitoring device which detects a car position from an amount of movement of the car from the reference position, corrects the detected car position using a signal from the car position detection device, and monitors the presence or absence of overspeed of the car on the basis of an overspeed detection pattern that varies in accordance with a car position, wherein the car position detection device includes a first car position detection sensor and a second car position detection sensor which are arranged side by side in a vertical direction, and the safety monitoring device performs, in parallel, first overspeed monitoring based on a car position corrected using a signal from the first car position detection sensor and second overspeed monitoring based on a car position corrected using a signal from the second car position detection sensor.

Effects of the Invention

In the elevator apparatus according to the present invention, a first car position detection sensor and a second car position detection sensor are arranged side by side in a vertical direction, and first overspeed monitoring based on a car position corrected using the signal from the first car position detection sensor and second overspeed monitoring based on a car position corrected using the signal from the second car position detection sensor are performed in parallel, hence reliability of an overspeed monitoring function can be sufficiently ensured while suppressing the number of detection members to be installed in a hoistway.

DESCRIPTION OF EMBODIMENTS

An embodiment of the present invention will be described hereinafter with reference to the drawings.

First Embodiment

Figure 1:
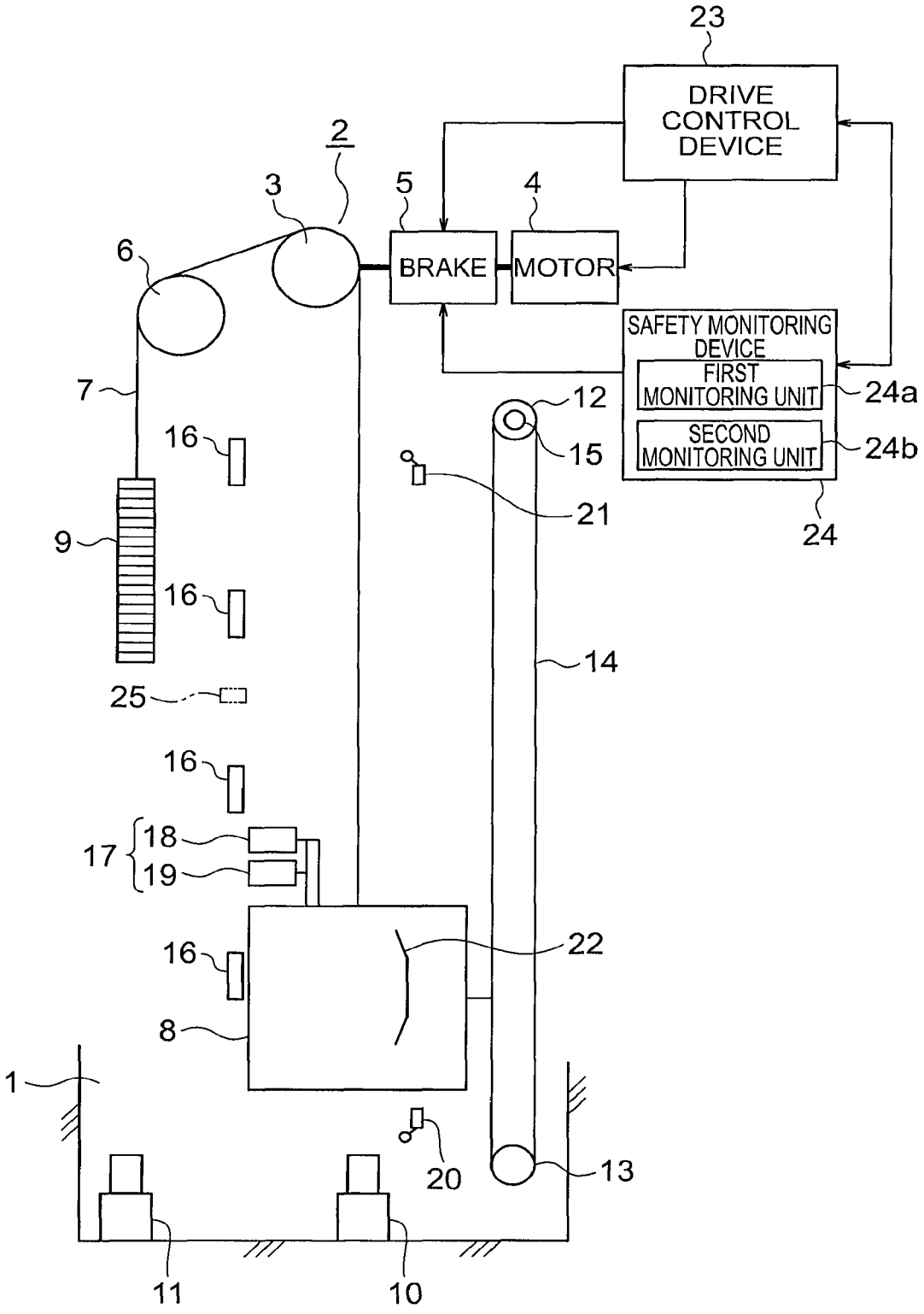
FIG. 1 is a configuration diagram showing an elevator apparatus according to a first embodiment of the present invention.

FIG. 1 is a configuration diagram showing an elevator apparatus according to a first embodiment of the present invention. In FIG. 1, a hoisting machine 2 is provided in an upper section of a hoistway 1. The hoisting machine 2 includes a drive sheave 3, a motor 4 for rotating the drive sheave 3, and a brake 5 for braking the rotation of the drive sheave 3.

An electromagnetic brake, for example, is used as the brake 5. The electromagnetic brake includes a brake wheel (a drum or a disk) that rotates integrally with the drive sheave 3, a brake shoe for friction-braking the brake wheel, a brake spring that presses the brake shoe against the brake wheel, and an electromagnet that pulls the brake shoe away from the brake wheel counter to the brake spring.

A deflection sheave 6 is provided in the vicinity of the drive sheave 3. A suspending body 7 is wound around the drive sheave 3 and the deflection sheave 6. A plurality of ropes or a plurality or belts are used as the suspending body 7.

A car 8 is connected to a first end of the suspending body 7. A counterweight 9 is connected to a second end of the suspending body 7. The car 8 and the counterweight 9 are suspended in the hoistway 1 from the suspending body 7. Further, the car 8 and the counterweight 9 are raised and lowered in the hoistway 1 due to the drive sheave 3 being rotated by the motor 4.

A pair of car guide rails (not shown) for guiding the ascent and descent of the car 8 and a pair of counterweight guide rails (not shown) for guiding the ascent and descent of the counterweight 9 are installed in the hoistway 1. A safety gear (not shown) implementing emergency stop of the car 8 by gripping the car guide rails is mounted on the car 8. A car buffer 10 and a counterweight buffer 11 are installed at the bottom of the hoistway 1.

An upper pulley 12 is provided in the upper section of the hoistway 1. A lower pulley 13 is provided in a lower section of the hoistway 1. A rope 14 is wound around the upper pulley 12 and the lower pulley 13 in the form of a loop. The rope 14 is connected, at one part thereof, to the car 8. As the car 8 runs, the rope 14 circulates and the upper pulley 12 and the lower pulley 13 rotate. In other words, the upper pulley 12 and the lower pulley 13 rotate at a speed that corresponds to the running speed of the car 8.

The upper pulley 12 is provided with a pulse signal generator 15 which serves as a movement signal generator for generating a signal that corresponds to an amount of movement of the car 8. An encoder, for example, is used as the pulse signal generator 15. The pulse signal generator 15 generates a pulse that corresponds to the rotation amount of the upper pulley 12.

Further, the pulse signal generator 15 is dual-configured and simultaneously outputs detection signals of two mutually independent systems, which are a first detection signal and a second detection signal, with respect to the rotation of the common upper pulley 12.

In the hoistway 1, a plurality of floor plates 16 are installed, as detection members, at intervals in the vertical direction. The floor plates 16 are arranged respectively at positions corresponding to a plurality of stop floors. Further, the floor plates 16 are all arranged at the same position in the hoistway 1 when viewed from directly above.

A car position detection device 17 for detecting the floor plates 16 is mounted on the car 8. The car position detection device 17 includes a first landing sensor 18, which serves as a first car position detection sensor, and a second landing sensor 19, which serves as a second car position detection sensor. The first and second landing sensors 18 and 19 are arranged side by side in the vertical direction.

Proximity sensors, such as magnetic sensors, eddy current type sensors, or optical type sensors, which detect the floor plates 16 contactlessly, can be used as the first landing sensor 18 and the second landing sensor 19.

A bottom floor switch 20, which serves as a reference position detector, is installed at a position that corresponds to a bottom floor in the hoistway 1. A top floor switch 21, which serves as a reference position detector, is installed at a position that corresponds to a top floor in the hoistway 1. The car 8 is provided with a switch operating rail 22 which serves as an operating member for operating the bottom floor switch 20 and the top floor switch 21.

The reference positions in the hoistway 1 of the first embodiment are the bottom floor and the top floor. The bottom floor switch 20 detects that the car 8 is located at the bottom floor. The top floor switch 21 detects that the car 8 is located at the top floor.

The bottom floor switch 20 is opened by the switch operating rail 22 when the car 8 approaches the bottom floor and is kept open while the car 8 is stopped at the bottom floor. The top floor switch 21 is opened by the switch operating rail 22 when the car 8 approaches the top floor and is kept open while the car 8 is stopped at the top floor. Further, usually-closed, positive opening switches in which sticking failures do not occur are used as the bottom floor switch 20 and the top floor switch 21.

The running of the car 8 is controlled by a drive control device 23. The drive control device 23 controls the running speed of the car 8 by controlling the rotation speed of the motor 4. Further, the drive control device 23 detects a car position using signals from the pulse signal generator 15, the first landing sensor 18, and the second landing sensor 19, and stops the car 8 at a landing position on a destination floor.

At this time, since the first landing sensor 18 and the second landing sensor 19 are arranged side by side in the vertical direction, the first landing sensor 18 and the second landing sensor 19 detect the same floor plate 16 at different timings. For this reason, the drive control device 23 sets positions, at which the floor plates 16 are detected, by both the first landing sensor 18 and the second landing sensor 19 as landing target positions.

Further, when the car 8 is stopped at a landing position, the drive control device 23 activates the brake 5 to prevent the car 8 from moving inadvertently. In addition, upon receiving a speed restriction command from a safety monitoring device 24, the drive control device 23 controls the running speed of the car 8 to be lower than that during normal operation. Moreover, upon receiving a learning operation command from the safety monitoring device 24, the drive control device 23 causes the car 8 to run reciprocally at low-speed.

The drive control device 23 and the safety monitoring device 24 each have an independent computer. The safety monitoring device 24 detects a car position independently of the drive control device 23 by using the signals from the pulse signal generator 15, the first landing sensor 18, the second landing sensor 19, the bottom floor switch 20, and the top floor switch 21.

Moreover, the safety monitoring device 24 includes first and second monitoring units **24*a* and 24*b*. The first monitoring unit 24*a* has a first calculation unit, detects a car position using an amount of movement of the car 8 from the bottom floor or the top floor, and corrects the detected car position by using the signal from the first landing sensor 18**.

The second monitoring unit **24*b* has a second calculation unit, detects a car position by using the amount of movement of the car 8 from the bottom floor or the top floor, and corrects the detected car position by using the signal from the second landing sensor 19**.

Same overspeed detection patterns, which serve as monitoring references and vary according to car positions, are set respectively in the first and second monitoring units **24*a* and 24*b*. In other words, two overspeed detection patterns are set in the safety monitoring device 24**.

Moreover, the first and second monitoring units 24*a* and 24*b* each detect the speed of the car 8 by arithmetically processing the signal from the pulse signal generator 15.

The first monitoring unit 24*a* monitors the presence or absence of overspeed of the car 8 on the basis of a car position corrected using the signal from the first landing sensor 18 and the overspeed detection pattern (first overspeed monitoring). The second monitoring unit 24*b* monitors the presence or absence of overspeed of the car 8 on the basis of position information corrected using the signal from the second landing sensor 19 and the overspeed detection pattern (second overspeed monitoring).

In this way, the safety monitoring device 24 executes, independently of each other and in parallel, the first overspeed monitoring using the signal from the first landing sensor 18 and the second overspeed monitoring using the signal from the second landing sensor 19.

The safety monitoring device 24 stores learned values, which are results of measuring distances to reach the top floor and distances to reach the bottom floor from positions at which the floor plates 16 are detected by the first and second landing sensors 18 and 19.

Figure 2:
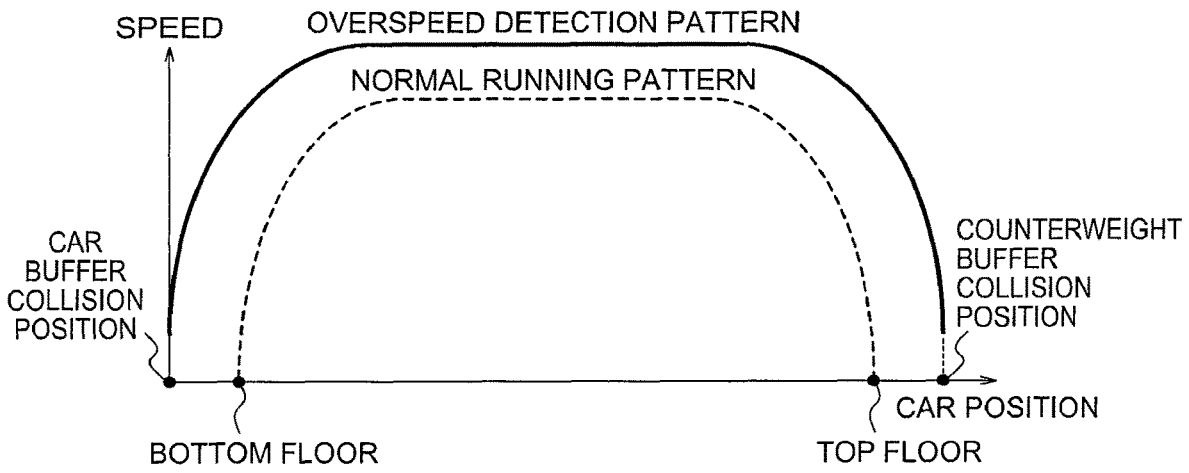
FIG. 2 is a graph showing an overspeed detection pattern set in a safety monitoring device shown in FIG. 1.

FIG. 2 is a graph showing an overspeed detection pattern set in the safety monitoring device 24 shown in FIG. 1. The normal running pattern is a speed pattern when the car 8 runs at a normal speed (rated speed) from a lower end floor to an upper end floor (or, from the upper end floor to the lower end floor).

The overspeed detection pattern is set higher than the normal running pattern. Moreover, the overspeed detection pattern is set to be separated from the normal running pattern by an equal or substantially equal interval over the entire ascent/descent course. Further, although the overspeed detection pattern is set to be constant in the vicinity of intermediate floors, in the vicinity of the end floors, the overspeed detection pattern is set so as to continuously and smoothly become lower as the car 8 approaches ends (an upper end and a lower end) of the hoistway 1.

The safety monitoring device 24 activates the brake 5 when overspeed is detected. At this time, a speed at which the car 8 collides with the car buffer 10 or a speed at which the counterweight 9 collides with the counterweight buffer 11 can be reduced due to the setting of an overspeed detection pattern such as that described above, whereby the shock absorbers 10 and 11 can be downsized.

Further, the safety monitoring device 24 constantly compares a car position corrected using the signal from the first landing sensor 18 and a car position corrected using the signal from the second landing sensor 19 and, when the difference between both is greater than a set value, determines that an abnormality has occurred in detection of a car position and outputs a command to stop the car 8 at the nearest floor thereto to the drive control device 23. The set value, which serves as a reference for determining that an abnormality has occurred in the detection of a car position, is set to a value that is greater than a sensor tolerance.

Further, the safety monitoring device 24 outputs a command to activate the brake 5 following the lapse of a set period of time from when determination is made that an abnormality has occurred in detection of a car position. The set period of time is set to a value that is greater than a period of time in which the car 8 can be stopped at the nearest floor thereto, regardless of a location thereof in the hoistway 1.

Figure 3:
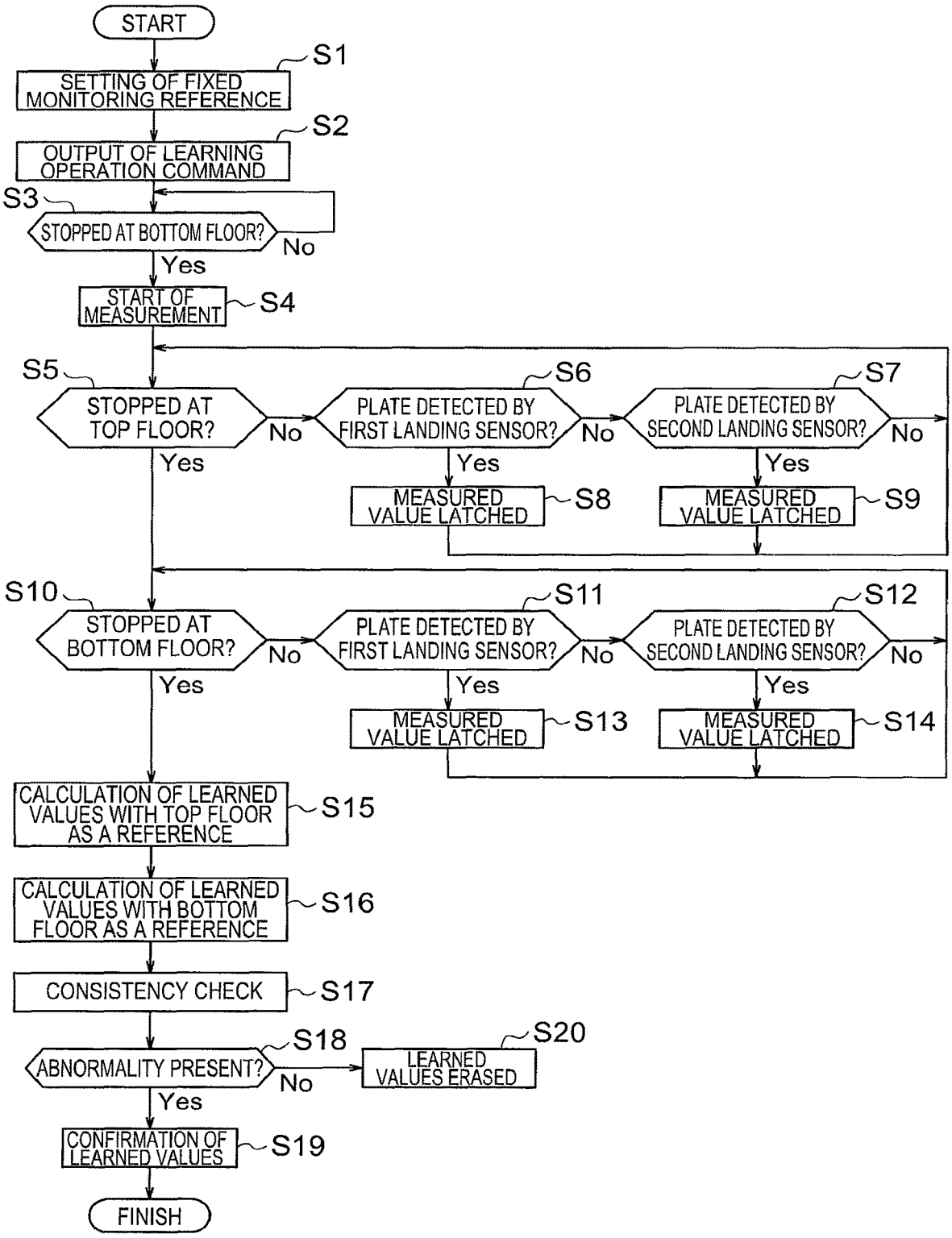
FIG. 3 is a flowchart showing an operation of the safety monitoring device shown in FIG. 1 during a learning operation.

Next, the operation of the safety monitoring device 24 will be described. FIG. 3 is a flowchart showing an operation of the safety monitoring device 24 shown in FIG. 1 during a learning operation. Through this learning operation, the safety monitoring device 24 learns, and stores as learned values, an ascent/descent course and positions at which the floor plates 16 are detected. When the learning operation is started, the car 8 is stopped at the bottom floor.

When the learning operation is started, the safety monitoring device 24 sets an overspeed monitoring reference for the learning operation, this overspeed monitoring reference being constant regardless of car position and sufficiently lower than the rated speed (step S1). As a result, safety is ensured in the unlikely event that the car 8 collides with the car buffer 10 or the counterweight 9 collides with the counterweight buffer 11.

Subsequently, the safety monitoring device 24 outputs a learning operation command to the drive control device 23 (step S2). As a result, the drive control device 23 causes the car 8 to run reciprocally between the bottom floor and the top floor.

More specifically, the car 8 is moved from the bottom floor to the top floor, and then moved back to the bottom floor again. If the car 8 is not stopped at the bottom floor when the learning operation command is received, reciprocal operation is started once the car 8 has been moved to the bottom floor. Further, the running speed of the car 8 during the learning operation is set to be even lower than the overspeed monitoring reference for the learning operation.

Note that the safety monitoring device 24 sets a position at which a floor plate 16 is detected, while the bottom floor switch 20 is OFF, as the bottom floor, and a position at which a floor plate 16 is detected, while the top floor switch 21 is OFF, as the top floor.

After outputting the learning operation command, the safety monitoring device 24 confirms whether or not the car 8 is stopped at the bottom floor (step S3). If the car 8 is stopped at the bottom floor, measurement of a running distance by using the signal from the pulse signal generator 15 (step S4) is started. If the car 8 is not stopped at the bottom floor, measurement of the running distance is started after waiting for the car 8 to stop at the bottom floor.

The safety monitoring device 24 then repeatedly confirms whether or not a floor plate 16 has been detected by the first landing sensor 18 and whether or not a floor plate 16 has been detected by the second landing sensor 19 until the car 8 reaches the top floor and stops (steps S5 to S7). At this time, the safety monitoring device 24 determines positions at moments when the landing sensors 18 and 19 reach a position at a lower end of a floor plate 16 and when the signals of the landing sensors 18 and 19 edge, as plate detection positions.

When a floor plate 16 is detected by the first and second landing sensors 18 and 19, a measured value of running distance at this time is latched (held) (steps S8 and S9).

After the car 8 reaches the top floor and briefly stops, it is repeatedly confirmed whether or not a floor plate 16 has been detected by the first landing sensor 18 and whether or not a floor plate 16 has been detected by the second landing sensor 19 until the car 8 reaches the bottom floor and stops (steps S10 to 12). At this time, the safety monitoring device 24 determines positions at moments when the landing sensors 18 and 19 reach a position at an upper end of a floor plate 16 and when the signals of the landing sensors 18 and 19 edge, as plate detection positions.

When a floor plate 16 is detected by the first and second landing sensors 18 and 19, a measured value of running distance at this time is latched (held) (steps S13 and S14).

Thereafter, the safety monitoring device 24 calculates a plurality of learned values, with the top floor as a reference (step S15). In other words, distances to reach the top floor landing position from positions, at which the respective floor plates 16 were detected by the landing sensors 18 and 19, when the car 8 ascends, are respectively ascertained, and edges in the signals of the landing sensors 18 and 19 are stored as absolute positions of the detected positions. The course from the bottom floor to the top floor is also stored as a learned value.

Subsequently, the safety monitoring device 24 calculates learned values, with the bottom floor as a reference (step S16). In other words, distances to reach the bottom floor landing position from positions, at which the respective floor plates 16 were detected by the landing sensors 18 and 19, when the car 8 descended, are respectively ascertained, and edges in the signals of the landing sensors 18 and 19 are stored as absolute positions of the detected positions. The course from the top floor to the bottom floor is also stored as a learned value.

Next, the safety monitoring device 24 compares the learned values obtained using the signal from the first landing sensor 18 and the learned values obtained using the signal from the second landing sensor 19, checks whether or not these learning values are consistent (step S17) and determines the presence or absence of an abnormality (step S18).

Here, if the difference between learned values corresponding to the same position is within a pre-set margin of error, it is determined that the learned values are consistent and that there is no abnormality. Further, as the distance between the first landing sensor 18 and the second landing sensor 19 in the vertical direction is known in advance, the learned values are compared after subtracting this distance.

If the learned values are consistent, the learned values are fixed (step S19) and the learning operation is terminated. On the other hand, if the learned values are not consistent, it is determined that an abnormality has occurred and the learned values are erased (step S20). After the learned values have been erased, a notification is made to this effect and service is suspended, or the process returns to step S2 and the learning operation is performed again.

When the learning operation is continued, a limit is set on the number of times the learning operation can be performed and, if consistency of the learning values cannot be realized despite the learning operation being executed for only the limited number of times, a notification is made to this effect and service is suspended. Moreover, in a case where the learned values are not consistent, a method of staring service at limited speed, which is used during learning operation, may be employed.

Figure 4:
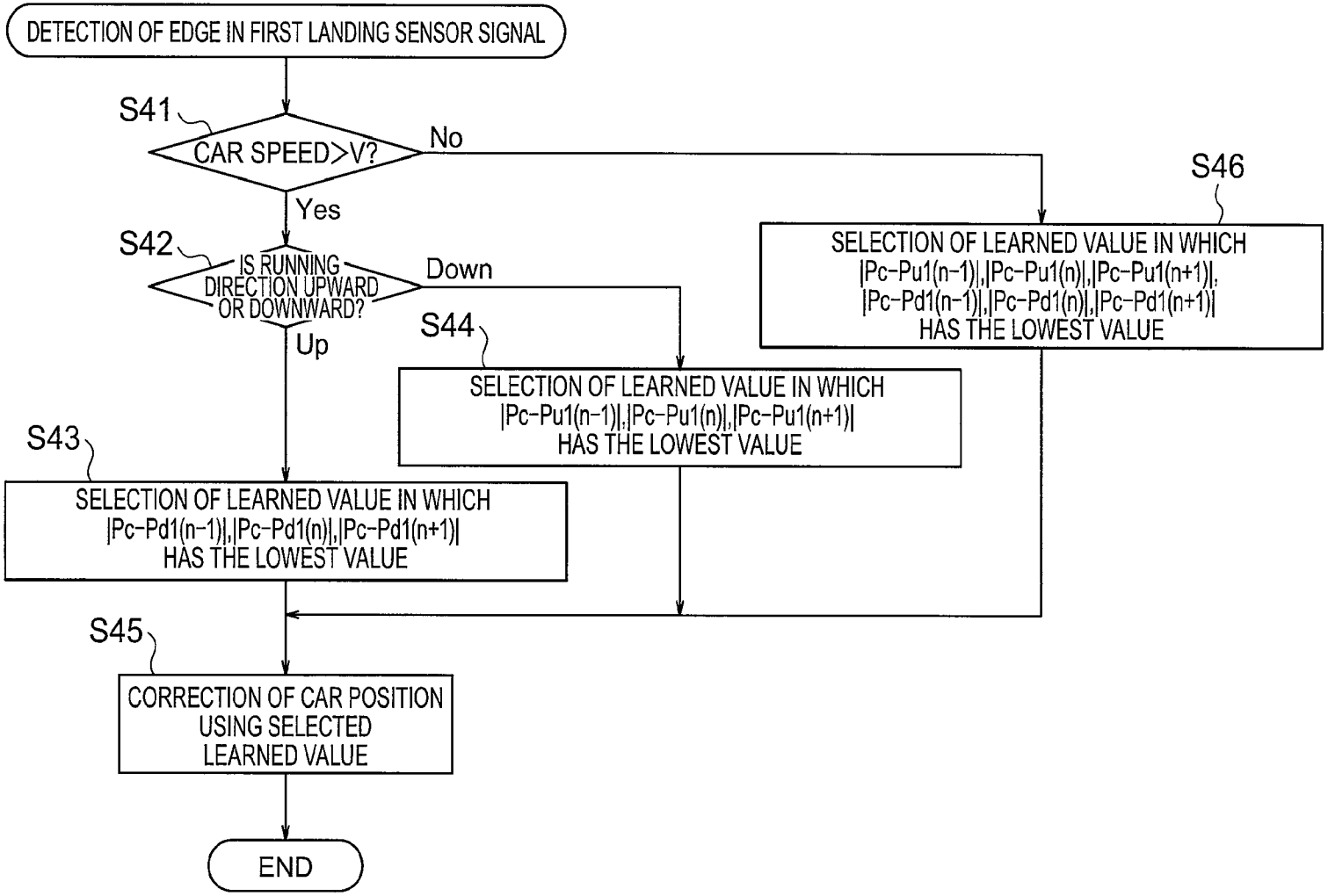
FIG. 4 is a flowchart showing a method of correcting car position information of the safety monitoring device using information from a first landing sensor shown in FIG. 1.

Next, the operation of the safety monitoring device 24 during normal operation will be described. FIG. 4 is a flowchart showing a method of correcting car position information of the safety monitoring device 24 by using information from the first landing sensor 18 shown in FIG. 1, and FIG. 5 is a flowchart showing a method of correcting car position information of the safety monitoring device 24 by using information from the second landing sensor 19 shown in FIG. 1.

Figure 5:
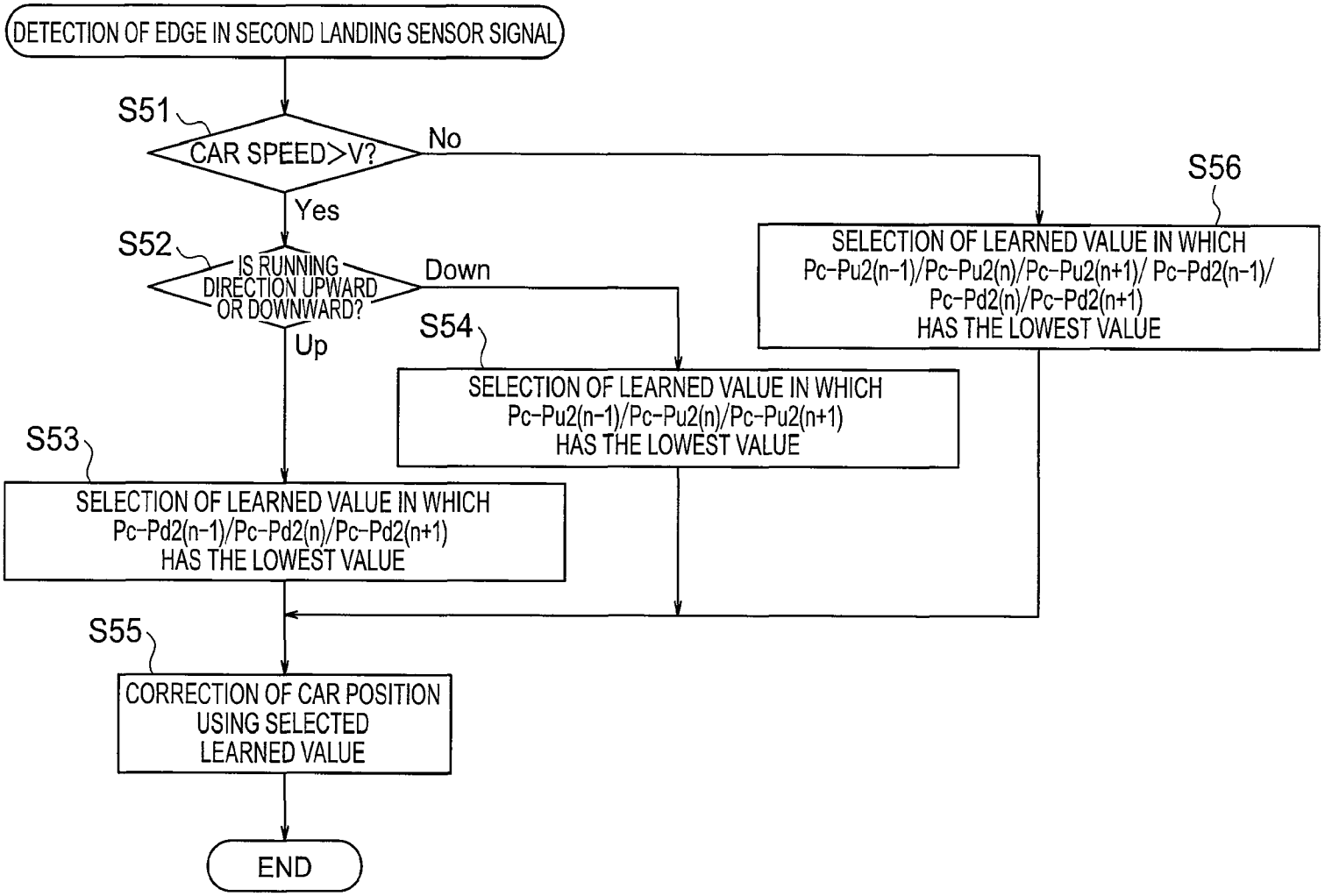
FIG. 5 is a flowchart showing a method of correcting car position information of the safety monitoring device using information from a second landing sensor shown in FIG. 1.

In FIG. 4 and FIG. 5, Pc is a position of the car 8 detected by the safety monitoring device 24 using information from the pulse signal generator 15.

In FIG. 4, Pd1(n) is a learned value obtained by the first landing sensor 18 at a lower end of a floor plate 16 passed immediately before. Pu1(n) is a learned value obtained by the first landing sensor 18 at an upper end of the floor plate 16 passed immediately before. Pd1(n−1) is a learned value obtained by the first landing sensor 18 at a lower end of a floor plate 16 beneath and adjacent to the floor plate 16 passed immediately before. Pu1(n−1) is a learned value obtained by the first landing sensor 18 at an upper end of the floor plate 16 beneath and adjacent to the floor plate 16 passed immediately before. Pd1(n+1) is a learned value obtained by the first landing sensor 18 at a lower end of a floor plate 16 that is above and adjacent to the floor plate 16 passed immediately before. Pu1(n+1) is a learned value obtained by the first landing sensor 18 at an upper end of the floor plate 16 above and adjacent to the floor plate 16 passed immediately before.

In FIG. 5, Pd2(n) is a learned value obtained by the second landing sensor 19 at a lower end of a floor plate 16 passed immediately before. Pu2(n) is a learned value obtained by the second landing sensor 19 at an upper end of the floor plate 16 passed immediately before. Pd2(n−1) is a learned value obtained by the second landing sensor 19 at a lower end of a floor plate 16 below and adjacent to the floor plate 16 passed immediately before. Pu2(n−1) is a learned value obtained by the second landing sensor 19 at an upper end of the floor plate 16 below and adjacent to the floor plate 16 passed immediately before. Pd2(n+1) is a learned value obtained by the second landing sensor 19 at a lower end of a floor plate 16 above and adjacent to the floor plate 16 passed immediately before. Pu2(n+1) is a learned value obtained by the second landing sensor 19 at an upper end of the floor plate 16 above and adjacent to the floor plate 16 passed immediately before.

Upon detecting an edge in the signal of the first landing sensor 18, the safety monitoring device 24 executes the operation shown in FIG. 4 and corrects the car position information used for the first overspeed monitoring. Further, upon detecting an edge in the signal of the second landing sensor 19, the safety monitoring device 24 executes the operation shown in FIG. 5 and corrects the car position information used for the second overspeed monitoring.

The method of correcting the car position information differs, depending on car speed when an edge is detected in the signal of the first landing sensor 18 or the second landing sensor 19. In other words, upon detecting edges in the signals of the landing sensors 18 and 19, the safety monitoring device 24 determines whether or not the car speed is greater than a set speed V (steps S41 and S51).

When the speed of the car 8 is greater than V, the running direction of the car 8 when an edge in the signal is detected is determined from the signal of the pulse signal generator 15 (steps S42 and S52). Then, when the car 8 is running in the upward direction, a learned value closest to the currently obtained car position is selected from among the learned value obtained at the lower end of the floor plate 16 detected immediately before and the learned values obtained at the lower ends of the floor plates 16 vertically adjacent thereto (steps S43 and S53), and the car position information is corrected (steps S45 and S55).

Further, when the car 8 is running in the downward direction, a learned value closest to the currently obtained car position is selected from among the learned value obtained at the upper end of the floor plate 16 detected immediately before and the learned values obtained at the upper ends of the floor plates 16 vertically adjacent thereto (steps S44 and S54), and the car position information is corrected (steps S45 and S55).

When the speed of the car 8 is equal to or lower than V, a learned value closest to the currently detected car position is selected from among the learned values obtained at the upper end and the lower end of the floor plate 16 detected immediately before and the learned values obtained at the upper ends and lower ends of the floor plates 16 vertically adjacent thereto (steps S46 and S56), and the car position is corrected (steps S45 and S55).

Here, a method of setting the set speed V will be described. When a distance between floors is long, an auxiliary plate 25 (FIG. 1) may be additionally installed as a member to be detected in a non-landing position between the floors in order to prevent large discrepancies in the car position information. The auxiliary plate 25 is disposed in the same position as the floor plates 16 when viewed from directly above. Further, in order to distinguish the auxiliary plate 25 from the floor plates 16, the auxiliary plate 25 is configured so as not to be detected by both the first landing sensor 18 and the second landing sensor 19 at the same time. In other words, the vertical dimension of the auxiliary plate 25 is sufficiently smaller than the vertical dimension of the floor plates 16.

For this reason, when running at high speed, the car 8 could pass the length of half the auxiliary plate 25 during one calculation cycle of the safety monitoring device 24. In such a case, erroneous determination many be made as to which of an upper end and a lower end of the auxiliary plate 25 a car position is close to, when an edge is detected in the signal of the first landing sensor 18 or the second landing sensor 19.

Therefore, when the speed of the car 8 is greater than the set speed V, determination is made as to which of an edge at an upper end and an edge at a lower end of a floor plate 16 or the auxiliary plate 25 was detected by using the running direction of the car 8 detected by the pulse signal generator 15.

On the other hand, when the car 8 is running at a low speed, the direction detected by the pulse signal generator 15 and the actual direction of the car 8 may contradict each other. Therefore, the set speed V is set to be less than a speed at which the car 8 passes the length of half of the auxiliary plate 25 during one calculation period of the safety monitoring device 24, and greater than the speed at which the direction detected by the pulse signal generator 15 and the actual direction of the car 8 contradict each other.

With such an elevator apparatus, since the first landing sensor 18 and the second landing sensor 19 are arranged side by side in the vertical direction, it is possible to suppress the number of the detection members to be installed in the hoistway 1. Further, as the first overspeed monitoring based on a car position corrected using the signal from the first landing sensor 18 and the second overspeed monitoring based on a car position corrected using the signal from the second landing sensor 19 are performed in parallel, an overspeed monitoring function can be maintained even if a fault occurs in one of the first and second landing sensors 18 and 19, and reliability of the overspeed monitoring function can be sufficiently ensured.

Further, as a car position corrected using the signal from the first landing sensor 18 is compared with a car position corrected using the signal from the second landing sensor 19, and determination is made that an abnormality has occurred when the difference between both is greater than a set value, it is possible to more reliably detect that a fault has occurred in one of first and second landing sensors 18 and 19 has failed.

Further, the positive opening switches are used as the bottom floor switch 20 and the top floor switch 21, and an overspeed detection pattern which declines towards the upper end and the lower end of the hoistway 1 is set. In addition, results of measuring distances to reach the top floor and distances to reach the bottom floor from positions, at which the floor plates 16 are detected by the first and second landing sensors 18 and 19, are stored in the safety monitoring device 24 as learned values. For this reason, when an abnormality occurs in the bottom floor switch 20 or the top floor switch 21, a learned value is always closer to an end floor than a correct value. Accordingly, an overspeed reference following completion of the learning process is closer to the intermediate floors, and safety is ensured.

Further, the floor plates 16 are used as detection members, and the first and second landing sensors 18 and 19 are used as first and second car position detection sensors, and this allows the drive control device 23 and the safety monitoring device 24 to use common apparatuses, whereby the number of hoistway apparatuses can be reduced.

Note that a governor sheave may be used as the upper pulley 12, a tension wheel may be used as the lower pulley 13, and a governor rope may be used as the rope 14.

Further, the detection members may be different members from the floor plates 16. In such a case, sensors that are different from the landing sensors 18 and 19 would be used as the first and second car position detection sensors.

Moreover, the movement signal generator is not limited to an encoder, and may also be a resolver, for example.

Further, the car may be caused to reciprocate from the top floor to the bottom floor during the learning operation.

Moreover, in the learning operation, a return course run start command may be output and measurement of a return course may be started after the car has been left on standby at the top floor or the bottom floor following running of an outward course and learned values for one way have been calculated.

Further, in the above-mentioned example, three learned values are referenced during normal operation, however, it is also possible to reference only a learned value for a floor plate 16 passed immediately before, or to reference the learned value for the floor plate 16 passed immediately before and a learned value for one of the floor plates 16 vertically adjacent to the floor plate 16 passed immediately before.

Moreover, the layout of the entire elevator apparatus is not limited to the layout shown in FIG. 1. For example, the present invention can be applied to an elevator apparatus having a 2:1 roping system or the like.

Further, the present invention can be applied to any type of elevator apparatus, that is to say, elevators that have a machine room, machine room-less elevators, double deck elevators, one-shaft multi-car type elevators in which a plurality of cars are arranged in a common hoistway, and so on.

The invention claimed is:

1. An elevator apparatus comprising:

a car which ascends and descends in a hoistway;

a reference position detector which detects that the car is located at a reference position in the hoistway;

a movement signal generator which generates a signal that corresponds to an amount of movement of the car;

a detection member which is installed in the hoistway;

a car position detection device which is mounted on the car and detects the detection member; and a safety monitoring device which detects a car position from an amount of movement of the car from the reference position, corrects the detected car position using a signal from the car position detection device, and monitors the presence or absence of overspeed of the car on the basis of an overspeed detection pattern that varies in accordance with a car position, wherein the car position detection device includes a first car position detection sensor and a second car position detection sensor which are adjacent, and one of the first and second car position detection sensors is above another of the first and second car position detection sensors, and the safety monitoring device performs, in parallel, first overspeed monitoring based on a car position corrected using a signal from the first car position detection sensor and second overspeed monitoring based on a car position corrected using a signal from the second car position detection sensor.

2. The elevator apparatus according to claim 1, wherein the safety monitoring device compares the car position corrected using the signal from the first car position detection sensor and the car position corrected using the signal from the second car position detection sensor and determines that an abnormality has occurred when the difference between the two corrected car positions is greater than a set value.

3. The elevator apparatus according to claim 1, wherein:

a top floor and a bottom floor are set as the reference position, the reference position detector is usually-closed, positive opening switches, the overspeed detection pattern is set so as to become gradually lower as the car approaches an upper end and a lower end of the hoistway, and the safety monitoring device stores learned values, which are results of measuring distances to reach the reference position from positions at which the detection member is detected by the first and second car position detection sensors.

4. The elevator apparatus according to claim 1, further comprising:

a drive control device which controls running of the car, wherein the detection member includes a plurality of floor plates respectively disposed at positions corresponding to a plurality of stopping floors, the first and second car position detection sensors are first and second landing sensors, and the drive control device sets positions, at which the floor plates are detected by both the first landing sensor and the second landing sensor, as landing target positions.

5. The elevator apparatus according to claim 4, wherein the detection member further includes an auxiliary plate, different from the plurality of floor plates, installed in a non-landing position between floors, and a vertical dimension of the auxiliary plate is smaller than a vertical dimension of each of the floor plates so that the auxiliary plate is not detected by both the first landing sensor and the second landing sensor at the same time.

6. An elevator apparatus comprising:

a car which ascends and descends in a hoistway;

a reference position detector which detects that the car is located at a reference position in the hoistway;

a movement signal generator which generates a signal that corresponds to an amount of movement of the car;

detection plates which are installed in the hoistway;

a car position detector which is mounted on the car and detects the detection plates; and safety monitoring circuitry which detects a car position from an amount of movement of the car from the reference position, corrects the detected car position using a signal from the car position detector, and monitors the presence or absence of overspeed of the car on the basis of an overspeed detection pattern that varies in accordance with a car position, wherein the car position detector includes a first car position detection sensor and a second car position detection sensor which are adjacent, and one of the first and second car position detection sensors is above another of the first and second car position detection sensors, and the safety monitoring circuitry performs, in parallel, first overspeed monitoring based on a car position corrected using a signal from the first car position detection sensor and second overspeed monitoring based on a car position corrected using a signal from the second car position detection sensor.

7. The elevator apparatus according to claim 6, wherein the safety monitoring circuitry compares the car position corrected using the signal from the first car position detection sensor and the car position corrected using the signal from the second car position detection sensor and determines that an abnormality has occurred when the difference between the two corrected car positions is greater than a set value.

8. The elevator apparatus according to claim 6, wherein:

a top floor and a bottom floor are set as the reference position, the reference position detector is usually-closed, positive opening switches, the overspeed detection pattern is set so as to become gradually lower as the car approaches an upper end and a lower end of the hoistway, and the safety monitoring circuitry stores learned values, which are results of measuring distances to reach the reference position from positions at which the detection plates to be detected are detected by the first and second car position detection sensors.

9. The elevator apparatus according to claim 6, further comprising:

drive control circuitry which controls running of the car, wherein the detection plates are at positions corresponding to a plurality of stopping floors, the first and second car position detection sensors are first and second landing sensors, and the drive control circuitry sets positions, at which the detection plates are detected by both the first landing sensor and the second landing sensor, as landing target positions.

10. The elevator apparatus according to claim 9, further comprising:

an auxiliary plate, different from the detection plates, at a non-landing position between floors, and a vertical dimension of the auxiliary plate is smaller than a vertical dimension of each of the detection plates so that the auxiliary plate is not detected by both the first landing sensor and the second landing sensor at the same time.

* * * * *